US006369310B1

(12) United States Patent
Brunson et al.

(10) Patent No.: US 6,369,310 B1
(45) Date of Patent: Apr. 9, 2002

(54) ELECTRONIC MUSICAL INSTRUMENT HAVING SERVER SECTION FOR REMOTE CONTROL OF SETTINGS OVER A COMMUNICATION CHANNEL

(75) Inventors: Lowell Brunson; Michael Nazarov, both of Hillsboro; John McFerran, North Plains, all of OR (US); Shoichi Kojima, Hamamatsu (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 09/668,204

(22) Filed: Sep. 22, 2000

(51) Int. Cl.[7] ..... G10H 7/00
(52) U.S. Cl. ..... 84/600; 84/620; 84/645
(58) Field of Search ..... 84/600, 645, 620

(56) References Cited

U.S. PATENT DOCUMENTS 5,442,128 A * 8/1995 Bodini et al. ..... 84/620
5,508,472 A * 4/1996 Hawkins
5,563,359 A * 10/1996 Okamura ..... 84/600
5,652,400 A * 7/1997 Fujimori et al. ..... 84/600
5,734,119 A * 3/1998 France et al. ..... 84/645 X
5,739,454 A * 4/1998 Kunimoto
5,892,171 A * 4/1999 Ide
6,175,872 B1 * 1/2001 Neumann et al.
6,180,862 B1 * 1/2001 Hirano ..... 84/645 X

* cited by examiner

*Primary Examiner*—Jeffrey Donels
(74) *Attorney, Agent, or Firm*—Foley & Lardner

(57) ABSTRACT

An electronic musical instrument has a server section to enable instrument settings to be made by remote control from a terminal on a client side through a communications circuit such as the Internet, and thus makes it possible to easily carry out the setting and resetting of an electronic musical instrument for which specialized knowledge is required.

20 Claims, 2 Drawing Sheets

ELECTRONIC MUSICAL INSTRUMENT HAVING SERVER SECTION FOR REMOTE CONTROL OF SETTINGS OVER A COMMUNICATION CHANNEL

RELATED APPLICATION

The present invention relates to Japanese Application 111019/99 (filed Sep. 24, 1999), from which priority is claimed.

FIELD OF INDUSTRIAL UTILIZATION

The present invention is one that relates to an electronic musical instrument that is made so that various settings for the electronic musical instrument can be carried out by remote control and more particularly by a remote terminal on the client side through a communications circuit such as the Internet.

BACKGROUND ART

In the past, large instruments such as those that are made in a unit with the room such as, for example, a pipe organ, have been achieved and marketed as an electronic musical instrument having an electronic sound source installed. These kinds of electronic musical instruments normally are assembled at the venue in which they are installed (church, hotel or hall) and, at the time of the installation, the tuning of the sound is matched to the acoustics of the venue. Each type of the complex parameters that are accommodated within the electronic musical instrument is connected to a terminal device and set and changed.

However, with regard to the setting of the inner portion of the electronic musical instrument concerned, it is necessary to make the settings in a form that is appropriate to each of the venues in which it is placed. Moreover, a large number of parameters exists for which setting and changing are required. In order to properly set and change these parameters, it is necessary to take into account, in addition to, of course, the size of the venue, such things as, for example, the materials of the walls and the floor. In addition, even in the same venue, since there are subtle changes in the acoustics due to such factors as the temperature, humidity and the number of people accommodated on that day, it is also necessary to carry out the settings to take into account these factors.

Because of this, the work to set and change these parameters is in fact difficult for someone with knowledge at the serviceman level and it is, at any rate, necessary for a technician who has specialized knowledge to go to the installed venue and set the parameters.

In addition, as was discussed above, since even though it is the same venue, there are subtle changes in the acoustics due to such factors as the temperature, humidity and the number of people accommodated on that day, it becomes necessary to reset the electronic musical instrument to conform to these factors on the day of the performance. However, because it is not always possible for a specialist technician to visit the installation venue, this kind of delicate resetting may be difficult and, even if it were possible, it would take a significant amount of time and labor. In particular, this may be especially true in those cases where the installed venue is in a foreign country.

Furthermore, even if the setting can be done correctly temporarily, there are times when it is necessary to redo the setting, for example, when another operator subsequently adds an erroneous operation after a setting has been done.

The present invention takes into consideration the aforementioned problems and, in preferred embodiments, comprises an electronic musical instrument with which it is possible to easily carry out the setting and resetting of the electronic musical instrument for which specialized knowledge is required.

SUMMARY OF THE DISCLOSURE

In order to address the problems discussed above, an electronic musical instrument according to embodiments of the present invention is equipped with a communications circuit interface section with which communications is carried out with an external device. Communications may be carried out by means, for example, of the TCP/IP protocol via a communications circuit. An electronic musical instrument according to embodiments of the present invention further includes an HTTP server function section with which the HTTP protocol is used. Data is exchanged between the communications circuit and the connected external device via the above mentioned communications circuit interface, and a control device in which data, including operation setting data for the computer control of the electronic musical instrument, is exchanged with the above mentioned HTTP server function section.

The control device also includes sensors with which the data for the setting environment of the electronic musical instrument is detected and made the operating setting data.

The external devices (such as a browser terminal, etc.) that are placed in a location that is separated from the electronic musical instrument carry out communications via the communications circuit and with the TCP/IP protocol via the communications circuit interface section of the electronic musical instrument. The operating setting data for the electronic musical instrument carries out remote operations via the HTTP server function. Accordingly, it is possible for an ordinary user to suitably carry out complex settings without the need for a technician having specialized knowledge regarding the parameter settings for the electronic musical instrument to visit the installation venue for the electronic musical instrument each time an adjustment or setting is desired.

BRIEF DESCRIPTION OF THE DRAWINGS

An explanation will be given below of a preferred embodiment of the present invention with reference to the drawings wherein.

DETAILED DESCRIPTION OF PREFERRED EMBODIMENTS

Figure 1:
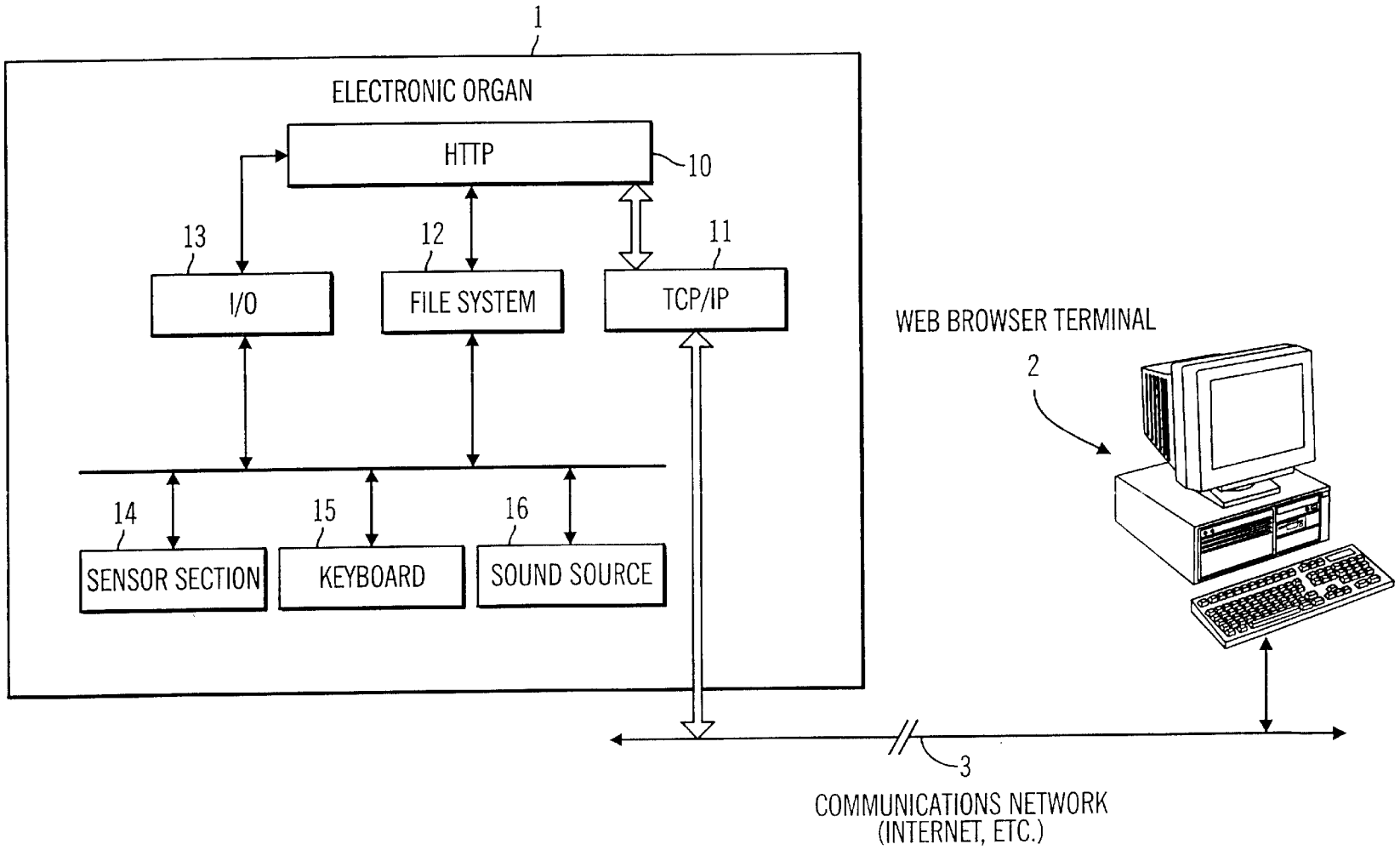
FIG. 1 depicts a functional block diagram of an electronic musical instrument as one preferred embodiment of the present invention, and FIGS. 2(*a*)–2(*c*) are drawings that show an illustration of virtual setting panel screens in a preferred system embodiment.

FIG. 1 depicts the functional block diagram of an electronic musical instrument as one preferred embodiment of the present invention. In the FIG. 1 embodiment, each of the various functions is accomplished with computer technology using a CPU, etc. However, such items of hardware as the CPU are not shown in FIG. 1 and their structures are indicated by functional blocks only.

In FIG. 1, an electronic organ 1 such as, for example, a pipe organ, is shown as an example of a computer controlled electronic musical instrument. A client terminal comprises a web browser terminal 2 and may be implemented by the installation of software in which the web browser function is achieved by, for example, a personal computer. However, in further embodiments, the web browser function may be provided by any suitable computer device, including but not limited to dedicated computer equipment, personal communication device or other suitable computer device coupled for communication over a communications network via network communications protocol.

A communications network 3 may be implemented, for example, by using an ordinary telephone circuit or a dedicated line or by an Internet circuit or intranet. The electronic organ 1 and the web browser terminal 2 are placed in locations that are separated from one another. The web browser terminal 2 is able to access the electronic organ 1 via the communications network 3 and it is possible to carry out various settings of the electronic organ 1 by remote control operation with the web browser terminal 2.

The electronic organ 1 is equipped with the sound source 16 controlled by operators (not shown) with which the musical tones are produced. The electronic organ 1 also includes a keyboard apparatus 15 for setting the operators for carrying out the performance, which are the usual performance functions of an electronic musical instrument. The electronic organ 1 also has a built-in HTTP server function as the function to carry out the exchange of data with the remote web browser terminal and each type of setting of the instrument.

In other words, in the main body of the electronic organ 1, the keyboard and the tone quality selection buttons are installed and carry out their usual performance functions. In addition, the main body of the electronic organ 1 is equipped with operators preferably in the smallest number possible, that are required at the time of a normal performance. The main body of the electronic organ 1 may also be provided with a local display device (not shown), such as a cathode ray tube (CRT) device, for example, to allow local display of information that may also be displayed at web browser terminal 2. In yet further embodiments, the local display device may comprise a projection display system, for example, to allow demonstrations of the capabilities of the system to large audiences.

For the latter operator functions, the electronic organ 1 is equipped with an input and output interface for the TCP/IP protocol and supports HTTP as one of the upper level services. The electronic organ 1 is structured so that documents that have been entered in hypertext markup language (HTML) with which web pages are constructed are stored in its file system. Therefore, the electronic organ 1 is provided with an HTTP server section 10, a TCP/IP interface section 11, a file system section 12, an I/O interface section 13 and a server section 14.

The HTTP server section 10 is one that supports the hypertext transfer protocol (HTTP) as one of its upper level services. The server section 10 uses the HTTP protocol, hypertext (HTML), as the protocol to transmit and is the functional section for the exchange of setting operation data with the web browser terminal 2. In preferred embodiments, the server section 10 is accomplished by the use of software. The HTTP server section 10 is, fundamentally, a World Wide Web (WWW) sever and, basically, performs the job of sending back the data that have been requested from the web browser terminal 2 on the client side as a document, etc. in HTML form, and of receiving the operator settings from the web browser terminal 2 for control of the sound source 16.

The TCP/IP interface section 11 is an interface section that uses the transmission control protocol/Internet protocol (TCP/IP) to communicate with the communications network 3 and to carry out communications with the web browser terminal 2. Data to be exchanged with the web browser terminal 2 is transmitted and received to and from the HTTP server section 10 by the interface section 11.

The file system section 12 stores, as operation setting data, the documents that are in the hypertext markup language (HTML) format with which web pages are constructed. The operation setting data comprises, for example, the setting values for each parameter on a virtual setting panel screens (shown in FIGS. 2(*a*)–2(*c*)) and the programs by which they are described (including Java applets and tcl/tk scripts) for carrying out the setting of each kind of parameter for the electronic organ 1. In addition, the electronic organ 1 includes memory which the keyboard apparatus 15 employs for storing the operating data with regard to, for example, each kind of sensor type including the sound source 16. The keyboard apparatus 15 accesses the operating setting data and the operating data from the web browser terminal 2 via the HTTP server 10 and is able to set and change the operating setting data in the electronic musical instrument as well as carry out the operation of the keyboard and the sound source in accordance with the operating data.

Figure 2:
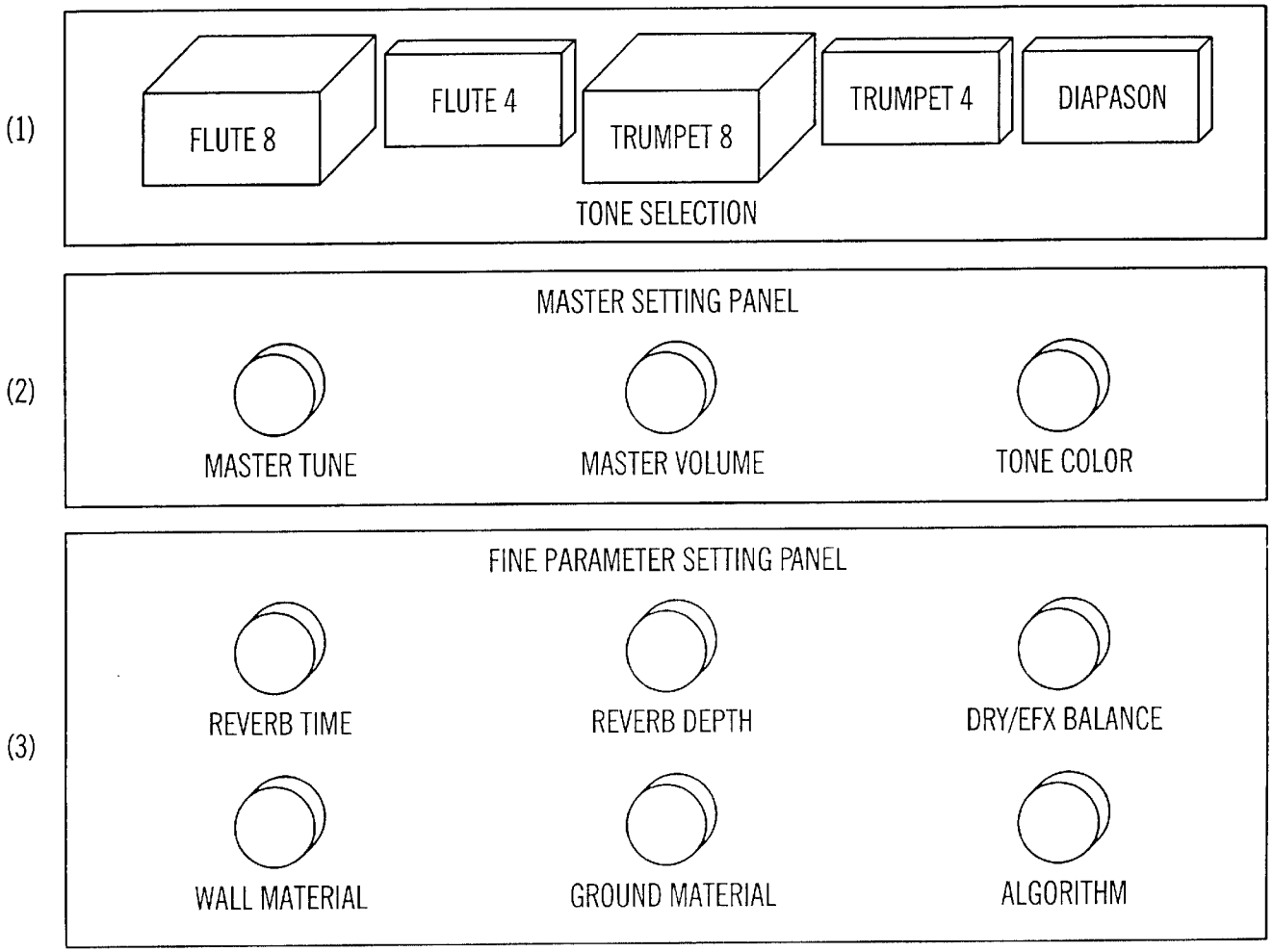

The virtual setting panel screens are as shown in FIGS. 2(*a*)–2(*c*). The virtual setting panels are displayed on the screen of the web browser terminal 2. The operator of the web browser terminal 2, by the operation of each kind of operator indicia on the screen while viewing these screens, is able to remotely set the parameters on the electronic organ 1. Thus, there is a correspondence (for example, but not limited to, a one-to-one correspondence) between the operator indicia displayed at the screen of the web browser with the operators 18. Normally, the remote operation is carried out by someone, like a technician, who possesses specialized knowledge, and settings are made that are optimum for the performer and the performance environment. The displays of the setting positions for each of the operators, etc. on these virtual setting panel screens are made so that they are in agreement with the actual setting condition for each kind of parameter of the electronic organ 1.

The screens in FIGS. 2(*a*)–2(*c*) are shown, respectively, as (FIG. 2(*a*)) a tone (timbre) selection panel, (FIG. 2(*b*)) a master setting panel and (FIG. 2(*c*)) a fine parameter setting panel. These panels need not be used during the performance itself but are sufficient to make each kind of adjustment that is required to be set preceding a performance.

The tone selection panel of FIG. 2(*a*) is a panel for the selection of any of the tones of an electronic organ such as flutes, trumpets and diapason. The displays of these panels are made to appear in the same form and arrangement as the operators appear on an acoustic pipe organ. In this manner, the displayed panels may be configured to look like the operators on an acoustic pipe organ.

The master setting panel of FIG. 2(*b*) is a virtual panel with which the parameters for the basic settings such as, for example, master tuning, master volume and tone color are carefully selected.

The fine parameter setting panel of FIG. 2(*c*) is a high level and complex virtual setting panel for the operation of additional fine functions and parameters. The fine parameter setting panel may be used to set, for example, parameters for the reverb time, the reverb depth, the dry/efx balance, the wall material, the floor material and the algorithm. In addition, the effect settings, the width and height of the venue and the number of people accommodated, temperature and humidity on the day of the performance may be set with the fine parameter setting panel.

The sensor section 14 is for the detection of the parameters regarding, for example, the environment in the vicinity of where the electronic organ 1 is located. In addition to such factors as the temperature and humidity in the located environment, the sensor section 14 detects (or receives an input value relating to) such factors as the number of people that are accommodated by the venue on the day of the performance. Thus, the sensor section includes one or more sensors, such as, but not limited to, temperature sensors, humidity sensors, or other environment characteristic sensors. The number of people in the venue may be detected by any suitable means including, but not limited to, a sensor for detecting the audio absorption or reflection coefficient of the venue, a sensor for measuring changes in ambient temperature in the venue caused by heat from people within the venue, a light sensor for detecting changes in lighting in the venue as people inhabit the venue, video image analysis systems for taking and analyzing video images of the venue, proximity sensors on or directed to each seat or groups of seats within the venue, or the like. Alternatively, or in addition, a value representing the number of people in the venue may simply be entered into the system by a user, for example, through a user interface, such as the keyboard, an operator or other interface means.

The I/O interface 13 is a section that is an interface which transmits the data that has been detected by the sensor section 14 to the web browser terminal 2 via the HTTP server section 10 or transmits the adjustment data for the various operators that have been received from the web browser terminal 2 to the operators 18 via the HTTP server section 10.

On the other hand, if it is possible to connect the web browser terminal 2 on the client side to the Internet, etc. via the communications network, then no matter where one is, each of the various kinds of sensors etc. of the electronic organ 1 including the keyboard apparatus 15 and the sound source 16 can be accessed by the web browser terminal 2 via the HTTP server section 10.

In further embodiments, multiple web browser terminals 2 may be provided on the client side. Thus, for example, in addition to the specialist technician located in a remote location, a terminal 2 may be provided for the performer to carry out operation and setting functions. Moreover, the operation and setting functions may be carried out in the same manner from such locations as an adjusting chamber in the performance venue.

In general, when a uniform resource locator (URL) is sent by a web browser (such as Internet Explorer or Netscape), the WWW server sends back the page data as an HTML format document. Accordingly, it is possible to view the web page at the address that has been specified by the URL. Therefore, in this preferred embodiment, the URL that has been assigned to the electronic organ 1 is used, the electronic organ 1 is accessed by the web browser terminal 2, each kind of operating setting data is obtained from the electronic organ via the HTTP server section 10, the virtual setting panels are displayed on the screen based on the operating setting data, the settings for each kind of parameter are made in accordance with the display screens and, by means of sending these setting data to the electronic organ 1, each kind of parameter of the electronic organ 1 is set and changed remotely.

An advantage of configuring the electronic organ with an HTTP server function in this manner is that it is possible to utilize the existing network communications infrastructure. Specifically, it is possible to use TCP/IP as the communications protocol, the HTTP protocol for server control and, in addition, to employ the HTML language for the data contents. In addition, it is possible to use existing HTTP server programs (freeware such as Apache) and web browser programs that conform to these protocols. Furthermore, for the hardware, existing devices or systems such as a personal computer, TCP/IP interface and Internet communications circuit (telephone line, ethernet, etc.) may be used.

For the preferred embodiments of the present invention, further variations and forms. For example, in the preferred embodiment discussed above, an explanation was given of a case where a large electronic organ, such as a pipe organ which is, so to speak, made in a unit with the room, is used as the electronic musical instrument of the present invention. However, the present invention is not restricted to the pipe organ example, but may employ other kinds of electronic musical instruments. Embodiments of the present invention may be applied to any suitable electronic musical instruments, preferably, those that require a higher level of specialized knowledge for setting their parameters.

In addition, the electronic musical instrument that is mentioned here is not limited to one in which the musical tones are generated electronically. Further embodiments may employ, for example, a pipe organ, the pipe adjustments for the generation of each type of musical tone of which are carried out mechanically but can be made so that their control is done by computer control, or an instrument like an electric guitar where the generation of the sounds themselves is done by the vibration of the strings, etc.

As has been described above, by means of the present invention, it is possible to carry out the setting and resetting of an electronic musical instrument for which specialized knowledge is required from a remote location without requiring a specialist technician to visit the place of installation.

Therefore, it is possible to carry out basic settings of an electronic musical instrument at the main unit and, in the case where these are accompanied by complex setting changes, to make the setting changes from a remote location, via a communications network.

With regard to complex setting changes, by such things as making it possible in this manner to do the setting only via a communications network, after the settings have been completed to match the condition of the venue, it is possible to make it so that setting changes cannot be carried out by erroneous operations. For example, the local display and user interface may be configured so that complex settings may not be available to the local user, while the remote terminal 2 may be configured to allow such complex settings. Alternatively, the electronic organ 1 may be provided with a lockout switch that may be activated to effectively disable any complex setting controls that may be on or local to the electronic organ 1, without disabling such capabilities of the remote terminal 2.

What is claimed is:

1. A method of controlling a musical instrument over a network comprising the steps of:

a. providing said instrument with a network server, b. connecting said server to a remote client site over said network, c. transmitting operation settings of said musical instrument over said network from said remote client site to said network server, and d. controlling said instrument using said transmitted operation settings.

2. The method as recited in claim 1 wherein said network comprises the internet.

3. The method as recited in claim 1 wherein said network comprises the world wide web, and said operator settings are transmitted using a TCP/IP protocol.

4. The method as recited in claim 3 wherein said operator settings are transmitted using a HTTP protocol.

5. The method as recited in claim 1 further comprising the steps of:

e. sensing environmental conditions in a venue of said musical instrument, f. Transmitting said environmental conditions to said client site, and g. Determining said operation settings based at least in part on said transmitted environmental conditions.

6. The method as recited in claim 5 wherein said environmental conditions include humidity of said venue.

7. The method as recited in claim 5 wherein said environmental conditions include temperature of said venue.

8. The method as recited in claim 5 wherein said environmental conditions include the number of people within said venue.

9. The method as recited in claim 5 wherein said environmental conditions include a wall material of said venue.

10. The method as recited in claim 5 wherein the environmental conditions include a ground or floor material of said venue.

11. The method as recited in claim 1 further comprising the steps of:

h. displaying at said client site a virtual display of a control panel for controlling operations of said musical instrument.

12. The method as recited in claim 11 wherein said musical instrument comprises an organ.

13. The method as recited in claim 11 wherein said musical instrument comprises an electronic organ.

14. A musical instrument comprising:

a. a plurality of operators, b. a sound source controlled by said plurality of operators, c. a server, d. an interface connecting said plurality of operators to said server, e. said server connectable to a network for control of said operators from a remote controller.

15. The musical instrument as recited in claim 14 wherein said network comprises the internet and said remote controller comprises a web browser terminal.

16. The musical instrument as recited in claim 14 further comprising:

f. a plurality of sensors for sensing conditions of a venue of said musical instrument, g. said sensors connected to said interface for transmitting sensed data via said server and network to said remote controller, and h. said remote controller controlling said operators based at least in part on said sensed data.

17. The musical instrument as recited in claim 16 wherein said network comprises the internet and said remote controller comprises a web browser terminal.

18. The musical instrument as recited in claim 16 wherein said server communicates with said remote controller using a HTTP protocol and said sensed data is transmitted over said network using a TCP/IP protocol.

19. The musical instrument as recited in claim 14 wherein said server communicates with said remote controller using a HTTP protocol and operator control data is transmitted over said network using a TCP/IP protocol.

20. An electronic musical instrument in which control of production of musical tones is carried out by means of computer control, said instrument comprising:

a communications circuit interface with which communications are carried out with an external device by means of the TCP/IP protocol via a communications circuit, and an HTTP server with which a HTTP protocol is used and data is transmitted over the communications circuit to and from the connected external device via the communications circuit interface, and wherein said external device includes a control device in which data, including operation setting data for the computer control of the electronic musical instrument, are transmitted to the HTTP server.

* * * * *